US005285832A

United States Patent [19]

Gibson

[11] Patent Number: 5,285,832

[45] Date of Patent: Feb. 15, 1994

[54] DEVICE FOR MORTISE, TENON AND DOVETAIL JOINERY

[75] Inventor: Jeremy H. Gibson, Eastlake, Ohio

[73] Assignee: Leichtung, Inc., Cleveland, Ohio

[21] Appl. No.: 928,456

[22] Filed: Sep. 3, 1992

[51] Int. Cl.[5] ..... B27M 3/00; B27C 5/00

[52] U.S. Cl. ..... 144/144.5 R; 33/197; 144/84; 144/144.5 GT; 144/372

[58] Field of Search ..... 144/83, 84, 85, 87, 144/137, 144 R, 144.5, 372; 33/197

[56] References Cited

U.S. PATENT DOCUMENTS 2,764,191 9/1956 Hartmann ..... 144/87
4,405,004 9/1983 Dicke ..... 144/87
4,479,523 10/1984 Peterson et al. ..... 144/87
4,607,673 8/1986 McCord, Jr. ..... 144/85
5,123,463 6/1992 Grisley ..... 144/372

*Primary Examiner*—W. Donald Bray
*Attorney, Agent, or Firm*—Frank B. Robb

[57] ABSTRACT

A combination dovetail, mortise and tenon jig, including a base unit which is used as a means of supporting different templates thereon, for use in forming the necessary elements involved in both dovetail and mortise and tenon joinery, the common elements being useful for both and providing accurate and consistently formed parts which are intended to interengage and perform the functions required of dovetail and mortise and tenon joints.

10 Claims, 2 Drawing Sheets

DEVICE FOR MORTISE, TENON AND DOVETAIL JOINERY

BACKGROUND OF THE DISCLOSURE

In mortise and tenon and dovetail joinery, there are certain formations which resemble one another even though they are in actuality intended to provide different kinds of joints and therefore it is desirable to provide a single base unit which will accept templates of various kinds, so that they may be useful to provide the elements which are those joined together in both dovetail and mortise and tenon joins of various sizes and descriptions.

In this particular instance there is developed a common base unit which by certain movements which are built in, will enable the machining of dovetail and mortise and tenon parts.

It is the concept hereof furthermore, to provide such a unit which will cut the various kinds of connecting elements in a manner such as heretofore performed by hand or by simple jigs which do not afford the nicety of positioning and flexibility of use which are desirable. Even though the joints themselves are not new, the method of making such joints and the equipment is developed from a different concept.

GENERAL DESCRIPTION OF THE INVENTION

The invention hereof is one which involves the provision of a common base unit which has built into it or fixed to it certain means for supporting templates and the movement thereof as well as a the positioning of the same into various positions for performing the development of mortise and tenon and dovetail joints, the latter usually being provide by router equipment which is commonly available, even though the formation of the particular parts is also common it is effected in an entirely different way by parts which have not heretofore been assembled as is here the case by the concept disclosed herein.

The device involves the use of templates which are positioned in various positions to perform the cutting operations by a router, as is common and thus make possible those formations as interengaging and as uniform, so that successive formation of such joints and parts thereof will make them interchangeable, if desired and also in repetitive quantities where appropriate.

Further the templates which are used herein, are of such a nature that they are positionable in the same relationship, time after time and can therefore successive mortise and tenon and dovetail joints in identical fashion as long as the base stock used to cut such joints is of substantial uniformity.

The concept further involves the ability to provide the kinds of joints referred to in thick and thin stock as well as wide and narrow stock thus providing a broad based means for making suitable and satisfactory dovetail and mortise and tenon joints.

The objects of the invention will be readily understood from the foregoing as residing in the use of a common base unit to which various templates may be applied and in turn make them suitable for machining the various parts of the kinds of joints here under consideration.

The foregoing have set forth the general concept and purposes of the invention, it will be seen that the same are disclosed in detail in the drawings appended hereto, wherein.

DETAILED DESCRIPTION OF THE INVENTION

Figure 1:
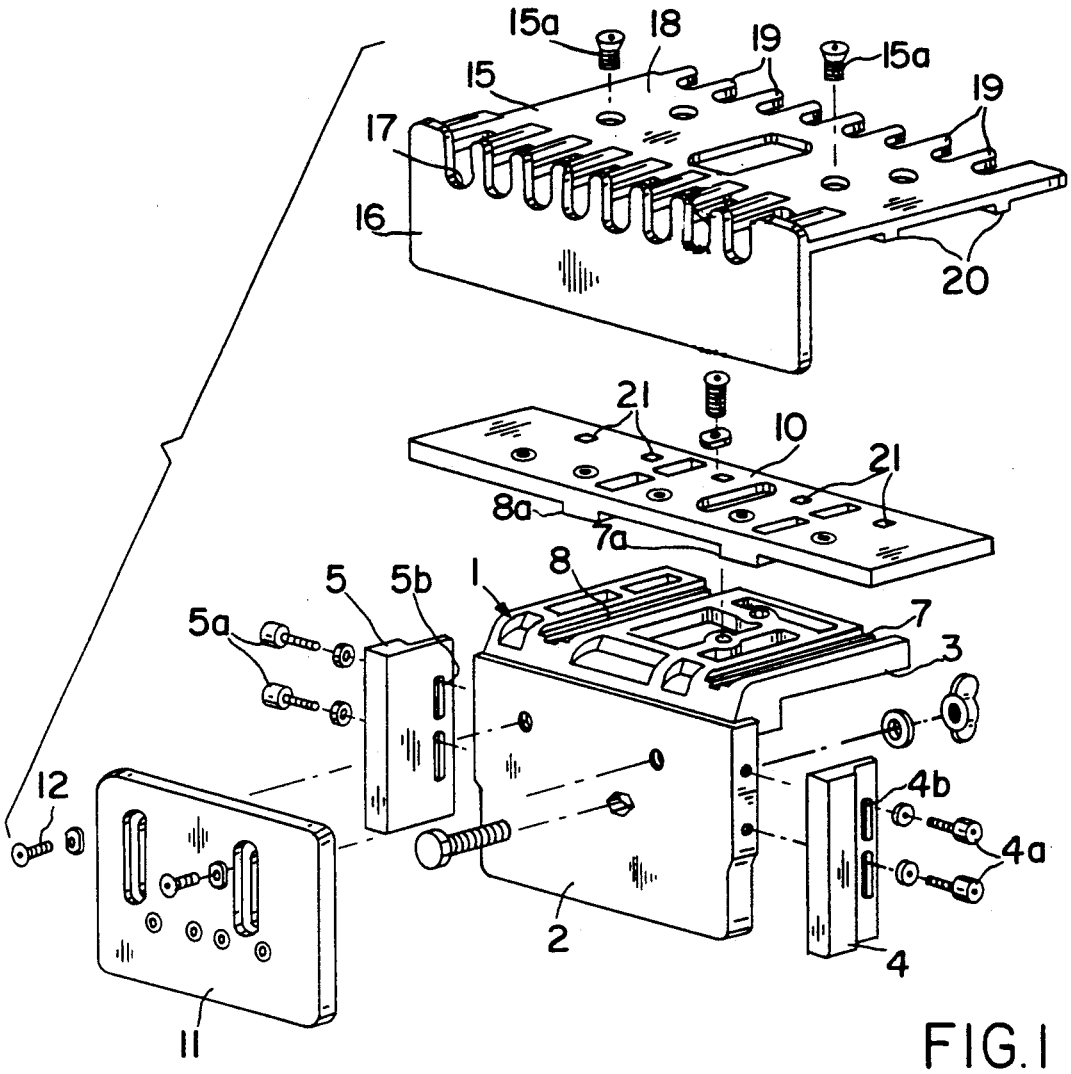
FIG. 1 is an exploded view of the device hereof as in position for assembly to perform a dovetail cutting operation for one of the elements of such a joint.

Referring now to FIG. 1 the invention is shown as including a base unit generally denoted 1, which is in fact a frame, including an upstanding leg 2 and an offstanding portion 3, which are integral in fact and include thereon certain formations which will be disclosed as this description proceeds.

Suitably mounted at either side of the upstanding leg 2, there is provided a stop plate such as 4 at one side and 5 at the other, these being identical and used in a manner which will be explained.

These stop plates are fastened by suitable fasteners 4*a* and 5*a* in a manner which by suitable slots 4*b* and 5*b* will provide for the adjustment of the same as necessary.

The offstanding portion of the main frame 2, specifically the portion 3 thereof is in turn formed with slide grooves 7 and 8 which are arranged to receive mating portions of a cross slide designated 10.

Figure 2:
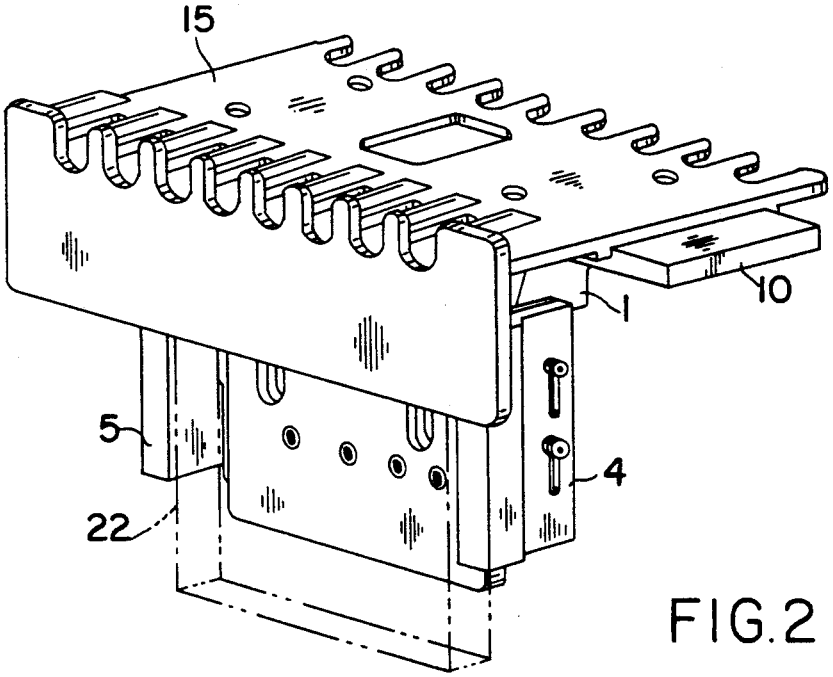
FIG. 2 is an assembled view of the elements of FIG. 1.

The cross slide 10 has extending from its lower surface the mating parts 7*a* and 8*a* for the purpose of guiding action when fitted in the slots 7 and 8 and as shown in FIG. 2, though not disclosed in detail therein.

The upstanding leg 2 of the main frame 1, is also equipped with a front spacer 11 fastened by suitable fasteners 12 at the face of the said leg, the fasteners being entered in the openings 12*a* therein.

The cross slide 10 is a generally rectangular in plan and in turn provides for the support and positioning of a template denominated a dovetail template in turn having a pin locating section 16 which includes at its upper edge a series of uniformly spaced openings 17 therein for purpose which will appear subsequently.

Offstanding from the section 16, is a plate 18 which includes at its edge a series of tongues 19 uniformly spaced for purposes which will also appear subsequently, these being what may be better be denominated as the tail locating section of the template here being referred to.

Depending from the underside of the template 15 are the guide tongues 20 provided to be positioned alongside the edges of the cross slide 10 previously mentioned and as will be apparent and shown in FIG. 2 to guide the template during transverse movement thereof.

Fore and aft movement of the template is effected by movement of the cross slide 10 where necessary, since the template is entirely supported by the cross slide for that movement.

When a piece of wood such as shown in phantom at 22, for example, which has previously been located so as to have the pin portions of a dovetail joint machined by means of a router bit passed in and through the openings 17, it will be understood that a series of such pins will have thereby been formed.

It should be noted that a piece of wood such as 22 will have been initially held in place between the portion 16 and the front spacer 11 by a clamp or the like, to enable the machining to be performed and the piece will thereafter be removed.

Figure 3:
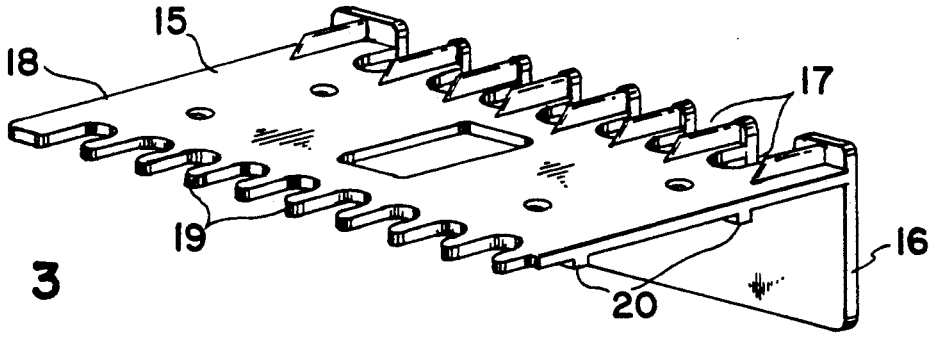
FIG. 3 is a reverse view of one of the templates shown in FIG. 1 to disclose the formation thereof.

By reversing the template 15 so that the tongues 19 extend in the position formerly occupied by the pin section 17, as suggested by a consideration of FIG. 3, the tails of the dovetail joint may thereafter be machined on the workpiece intended to mate with that previously machined, by a router as will be readily understood by those skilled in the art.

Further the template 15 will be secured to the cross slide 10 by screws such as 15*a* positioned to act for that purpose.

It may be noted that the cross slide is equipped with certain indicia located in areas below the surface and denoted at 21, so that they may assist in positioning the template just described and other which may be used in association with the device, and particularly of course, the frame unit just described in detail.

Turning now to a consideration of FIG. 2, it will be observed that the template 15 is in place on the cross slide 10 and fastened thereto as described and provides thereby a pocket where the previously mentioned piece of wood 22 has been located during the machining operation. This will also be the position that the mating piece of wood will occupy when it is machined, held in place by a suitable clamp.

Figure 4:
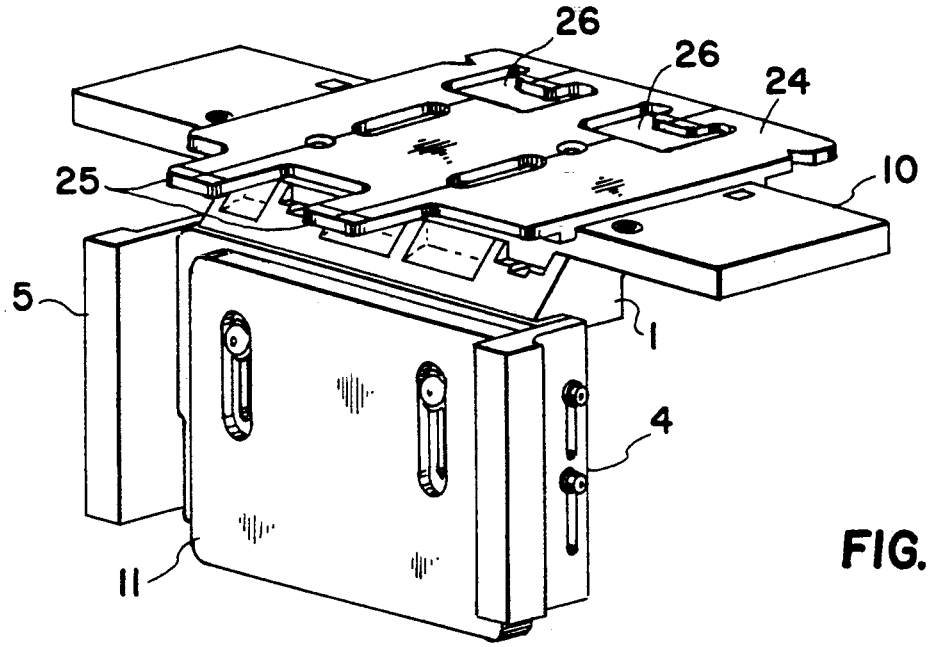
FIG. 4 is a fragmentary view showing the common base unit as having mounted thereon a template for mortise and tenon use.
Figure 5:
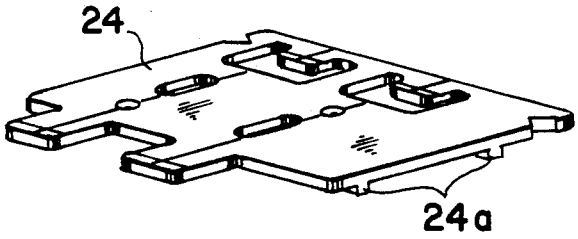
FIG. 5 is a template for mortise and tenon shown in the assembly of FIG. 4.

Referring now to FIG. 4, and turning to another phase of the use of the base unit it will be seen that the identical base unit and main frame 1 is availed of and positioned on the said unit the cross slide 10 is movable in the grooves provided. Adjustment of the stop plates 4 may be made to maintain the workpiece which is now to be machined so as to be provided with a tenon, for example.

For the forming of a tenon a tenon template 24 is positioned on the cross slide 10 as shown in the Figure, and secured in the proper position for the particular tenon desired, and thereafter a workpiece is located against the front spacer in position like that of FIG. 2, with the end adjacent the tongues 25.

Thereafter a suitable router with appropriate bit will be used and a portion of the tenon will thus be formed.

Thereafter the template 24 will be reversed so that the U-shaped cavities 26 will be above the workpiece, essentially in the position the tongues formerly occupied, and the router and bit caused to perform the necessary cutting operation, thereby completing the tenon.

Figure 6:
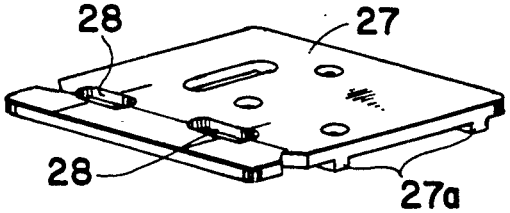
FIG. 6 is another mortise and tenon template which is required to complete such a joint when use in the combination hereof.

The mortise which is to receive the tenon just formed will be machined in another workpiece suitably similarly positioned, and another template 27 shown in FIG. 6, will be located to perform the necessary guiding of the cutter of a router through the cavities 28 for example, or one of them if only one mortise is to be used, and thereby form the mortise in which the tenon described may be located.

It will be apparent from the foregoing that the templates 24 and 27 are equipped with appropriate guide elements such as 24*a* and 27*a* respectively so as to position them properly on the cross slide 10 thus movable therealong and therewith as may be necessary or desirable in accordance with the positions in which the mortises and tenons are to be formed.

It is further to be understood that certain adjustments of the various parts may be made by reason of the various formations illustrated and described, fasteners necessary being furnished for the purpose.

I claim:

1. A device for cutting dovetail mortise and tenon joints consisting of a base unit, including a main frame, said main frame having an upstanding leg and an offstanding portion, a cross slide mounted on the offstanding portion, means to adjustably position said slide, at least one stop plate means at one side of the upstanding leg, and a dovetail cutting template consisting of a first pin locating section and a second tail locating section fixed to each other, said template being mounted on the cross slide, said first section of the template having a series of uniformly spaced openings in the edge at the juncture of the sections, the second section having a series of tongues extending from an edge remote from the openings, and means to fix the main frame, cross slide, spacer plate and cutter means template to position a workpiece for operations to be performed at their edges, whereby to permit close fitting interengagement thereof.

2. A device as claimed in claim 1, wherein the upstanding leg of the main frame and offstanding portion are fixed at right angles, the cross slide may be moved along the offstanding portion and fastened thereto, the stop plate means is fastened is fastened at one edge of the upstanding leg and the template is movable along the cross slide into different fixed positions.

3. A device as claimed in claim 1, wherein different templates may be positioned on the cross slide and present different formations by a cutting tool to provide interengaging joints.

4. A device as claimed in claim 1, wherein the template sections are fixed at right angles to one another and shiftable to present the openings and tongues to different positions with respect to a cutting member.

5. A device as claimed in claim 2, wherein the cross slide is movable transversely of the main frame and the template is movable fore and aft on the cross slide, the template being shiftable to different positions by shifting the main frame to present different mounting attitudes.

6. A device as claimed in claim 1, a tenon template being substituted for the dovetail template and secured to said cross slide, said template having at least one tang extending above and close to a workpiece positioned against the stop plate aforesaid, to facilitate machining such workpiece around the tang to form part of a tenon on said workpiece, said template having at least one U-shaped cavity therein which is aligned with the part of such tenon previously formed to complete the formation of that tenon.

7. A device as claimed in claim 6, wherein the template may be shifted by movement of the cross slide to change the size of tenon to be machined.

8. A device as claimed in claim 6, wherein the template is provided with at least a pair of tangs and cavities to facilitate uniform repetition of machining operations, thereby providing tenons uniformly spaced likewise.

9. A device as claimed in claim 6, and a mortise template secured to said cross slide replacing a tenon template previously secured in the same relative position, parts to secure the template to the cross slide in that position, the template having at least one cavity therein in which machining can be effected to produce a cavity to receive a tenon therein.

10. A device as claimed in claim 9, wherein the template includes at least a pair of cavities to enable uniform repetition of machining operations for uniform spacing of the cavities.

* * * * *